US012274299B2

(12) United States Patent
Liu

(10) Patent No.: US 12,274,299 B2
(45) **Date of Patent: *Apr. 15, 2025**

(54) HEATING CUP ASSEMBLY AND HOOKAH COMPRISING THE SAME

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 412 days.

This patent is subject to a terminal disclaimer.

(21) Appl. No.: 17/691,079

(22) Filed: Mar. 9, 2022

(65) Prior Publication Data

US 2023/0075439 A1 Mar. 9, 2023

(30) Foreign Application Priority Data

Sep. 6, 2021 (CN) ..... 202111040570.X
Sep. 6, 2021 (CN) ..... 202122144052.4

(51) Int. Cl.

| | |
|---|---|
| ***A24F 40/46*** | (2020.01) |
| ***A24F 1/12*** | (2006.01) |
| ***A24F 1/30*** | (2006.01) |
| ***A24F 40/42*** | (2020.01) |

(52) U.S. Cl.

CPC ..... *A24F 40/46* (2020.01); *A24F 1/12* (2013.01); *A24F 1/30* (2013.01); *A24F 40/42* (2020.01)

(58) Field of Classification Search

CPC ..... A24F 1/30; A24F 1/12
USPC ..... 131/173
See application file for complete search history.

(56) References Cited

U.S. PATENT DOCUMENTS

| | | | | |
|---|---|---|---|---|
| 754,338 | A * | 3/1904 | Pareis | A24F 1/30 131/211 |
| 4,133,318 | A * | 1/1979 | Gross | A24F 1/30 131/193 |
| 4,638,815 | A * | 1/1987 | Yoshioka | A24F 1/30 131/198.1 |
| 2010/0275937 | A1* | 11/2010 | Shakouri Moghadam | A24F 1/30 131/196 |
| 2014/0182606 | A1* | 7/2014 | Lotringer | A24F 1/30 131/173 |
| 2015/0257443 | A1* | 9/2015 | Rado | A24F 42/10 392/390 |
| 2016/0037825 | A1* | 2/2016 | Stein | A24D 1/14 131/226 |
| 2016/0295911 | A1* | 10/2016 | Kalousek | A24F 1/30 |
| 2017/0079321 | A1* | 3/2017 | Golz | A24F 40/46 |
| 2017/0224015 | A1* | 8/2017 | Basil | H05B 6/44 |
| 2018/0125115 | A1* | 5/2018 | Mueller | A24F 1/30 |
| 2020/0221788 | A1* | 7/2020 | Volodarsky | A24D 3/17 |
| 2022/0312834 | A1* | 10/2022 | Liu | A24F 7/00 |

* cited by examiner

*Primary Examiner* — Manley L Cummins, IV
(74) *Attorney, Agent, or Firm* — MATTHIAS SCHOLL P.C.; Matthias Scholl

(57) ABSTRACT

A heating cup assembly includes a first cup. The first cup includes a first cavity, a first side wall, and a second side wall. The first cavity is surrounded by the first side wall. The first side wall includes a first end and a second end. The second side wall includes a third end and a fourth end. The second end and the third end are disposed in one horizontal plane. The second side wall is in the shape of a truncated cone, and a diameter of the third end is less than that of the fourth end.

7 Claims, 7 Drawing Sheets

HEATING CUP ASSEMBLY AND HOOKAH COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202111040570.X filed Sep. 6, 2021, and to Chinese Patent Application No. 202122144052.4 filed Sep. 6, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a heating cup assembly and a hookah comprising the same.

Conventional heating cups for hookahs are cylindrical and disposed in the heaters. When not in use, the smoke or vapor condenses and blocks the air channels of the heaters, and the condensate is difficult to clean. Conventionally, the heating cup is formed integrally with the heater, which leads to difficulties in loading tobacco materials, in replacing the heating cup assembly, and in cleaning the hookah. Furthermore, the integrally-formed hookah is bulky, and inconvenient to carry.

SUMMARY

The first objective of the disclosure is to provide a heating cup assembly comprising a first cup; the first cup comprises a first cavity, a first side wall, and a second side wall; the first cavity is surrounded by the first side wall; the first side wall comprises a first end and a second end; the second side wall comprises a third end and a fourth end; the second end and the third end are disposed in one horizontal plane; the second side wall is in the shape of a truncated cone, and a diameter of the third end is less than that of the fourth end.

In a class of this embodiment, the second end is secured to the third end; or the heating cup assembly further comprises a connecting wall extending between the second end and the third end. The second end of the first side wall extends radially towards the third end of the second side wall to form the connecting wall.

In a class of this embodiment, one end of the first end comprises a first bottom wall; the first side wall and/or the first bottom wall comprises a heating layer; and the first cavity is configured to hold the tobacco materials.

In a class of this embodiment, the heating layer is disposed in a cavity of the first side wall, and/or is attached to an inner surface of the first side wall and/or an outer surface of the first side wall.

In a class of this embodiment, the heating layer comprises metal, carbon nanomaterial, or graphene.

In a class of this embodiment, the heating cup assembly further comprises a second cup disposed in the first cavity; and the second cup comprises a third side wall and a second cavity surrounded by the third side wall.

In a class of this embodiment, the second cup is detachably disposed in the first cup.

In a class of this embodiment, the second cup exceeds the first side wall in length.

In a class of this embodiment, one end of the third side wall comprises a second bottom wall; the third side wall and/or the second bottom wall comprises a heating layer.

In a class of this embodiment, the heating layer is disposed in a cavity of the third side wall, and/or is attached to an inner surface of the third side wall and/or an outer surface of the third side wall; and the heating layer comprises metal, carbon nanomaterial, or graphene.

In a class of this embodiment, the third side wall is matched with the first side wall in size and shape and the third side wall is disposed in the first cavity; and one end of the second cup extends radially towards the first cup to form a flange.

The second objective of the disclosure to provide a hookah; the hookah comprises the heating cup assembly and a heater; and the heating cup assembly is detachably disposed on the heater.

In a class of this embodiment, the heater comprises a fourth side wall and a top concave portion surrounded by the fourth side wall; the hookah further comprises a coil wrapped around the fourth side wall; and the heating cup assembly is detachably connected to the top concave portion.

In a class of this embodiment, the hookah further comprises a water jar detachably connected to the heating cup assembly.

The following advantages are associated with the heating cup assembly and the hookah of the disclosure: the heating cup assembly comprises a first cup provided with a second side wall; the condensate flows along the second side wall and re-enters the first cup, which prevents the condensate from overflowing in the hookah. Furthermore, the heating cup assembly is detachable, portable, and easy to clean.

Figure 1:
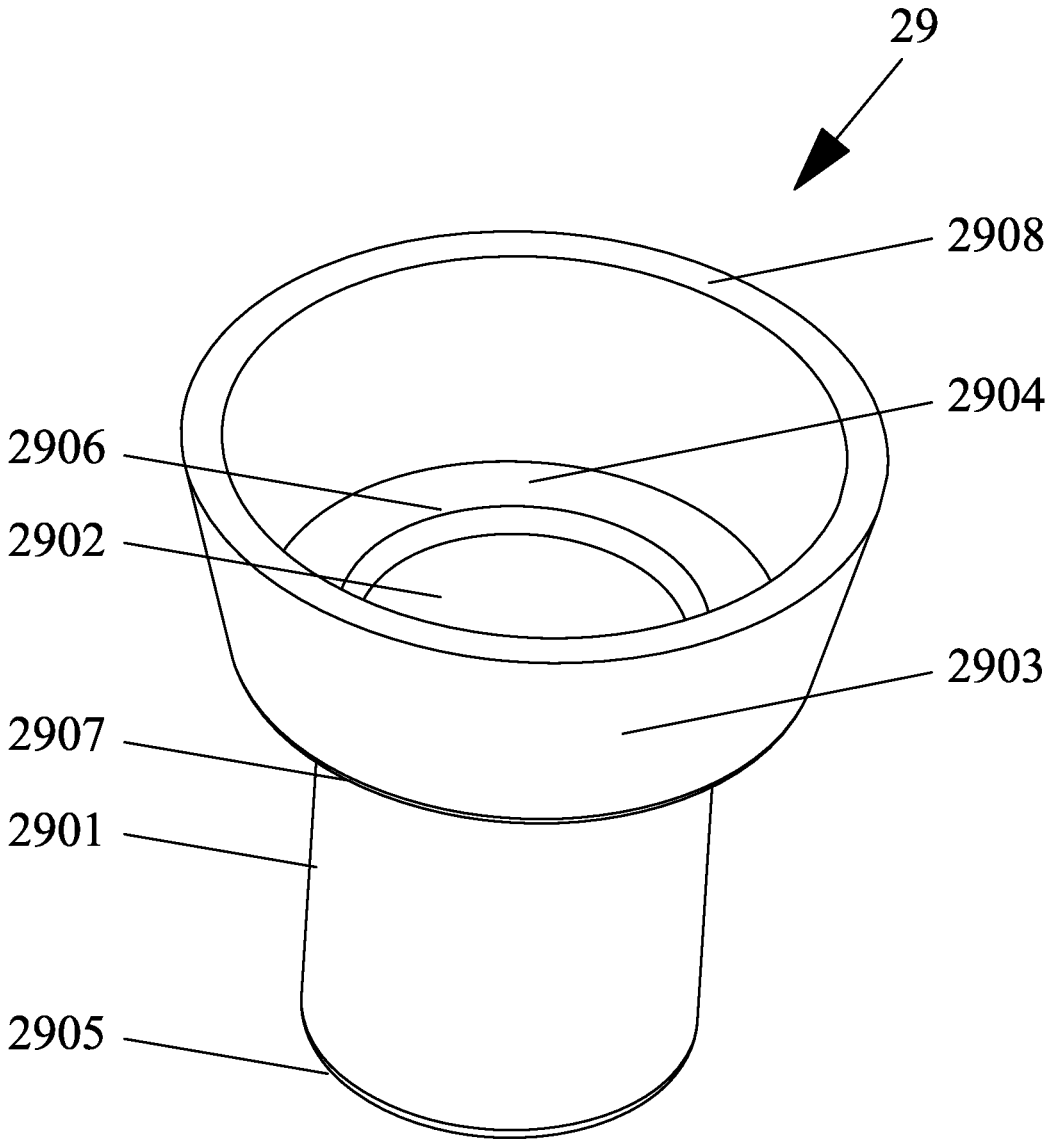
FIG. 1 is a perspective view of a first cup according to one example of the disclosure.

In the drawings, the following reference numbers are used: 5. Second cup; 10. Heating cup assembly; 20. Heater; 29. First cup; 201. Top concave portion; 501. Second cavity; 502. Third side wall; 503. Flange; 504. Second bottom wall; 2901. First side wall; 2902. First cavity; 2903. Second side wall; 2905. First end; 2906. Second end; 2907. Third end; 2908. Fourth end; and 2909. First bottom wall.

DETAILED DESCRIPTION

To further illustrate the disclosure, embodiments detailing a heating cup assembly and a hookah of the disclosure are described below. It should be noted that the following embodiments are intended to describe and not to limit the disclosure.

Figure 7:
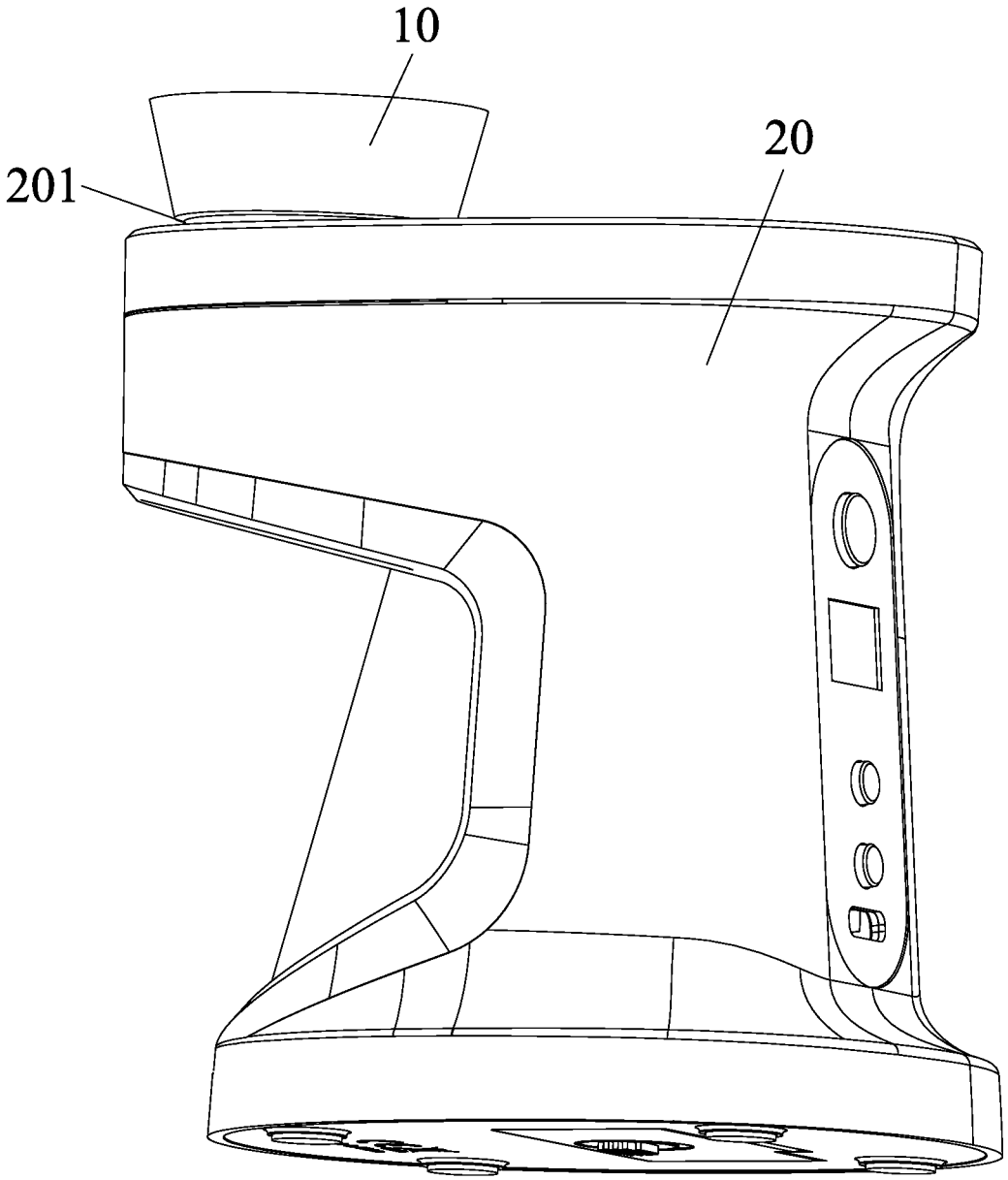
FIG. 7 is a perspective view of a heating cup assembly fitted with a heater according to one example of the disclosure.

Referring to FIG. 7, a hookah comprises a heating cup assembly 10, a water jar (not shown), and a heater 20. The heating cup assembly 10 is detachably disposed on the heater 20. Examples of such detachable means include screw threads, snap fasteners, interference fits, buckles, magnets, adhesives, and plugs.

In certain examples, the heater 20 comprises a top concave portion 201 surrounded by a fourth side wall. The hookah further comprises a coil wrapped around the fourth side wall. The heating cup assembly 10 is detachably connected to the concave portion 201 to allow for convenient assembly, disassembly, and cleaning of the hookah. Furthermore, the heating cup assembly need not be limited to the top concave portion 201. When energized, the coil produces an electromagnetic field which can heat the heating cup assembly 10 and transfer the heat to the tobacco materials. The tobacco materials produce smoke through high-frequency electromagnetic induction.

The water jar is detachably connected to the heating cup assembly 10 to allow convenient assembly, disassembly, and cleaning of the hookah.

Figure 2:
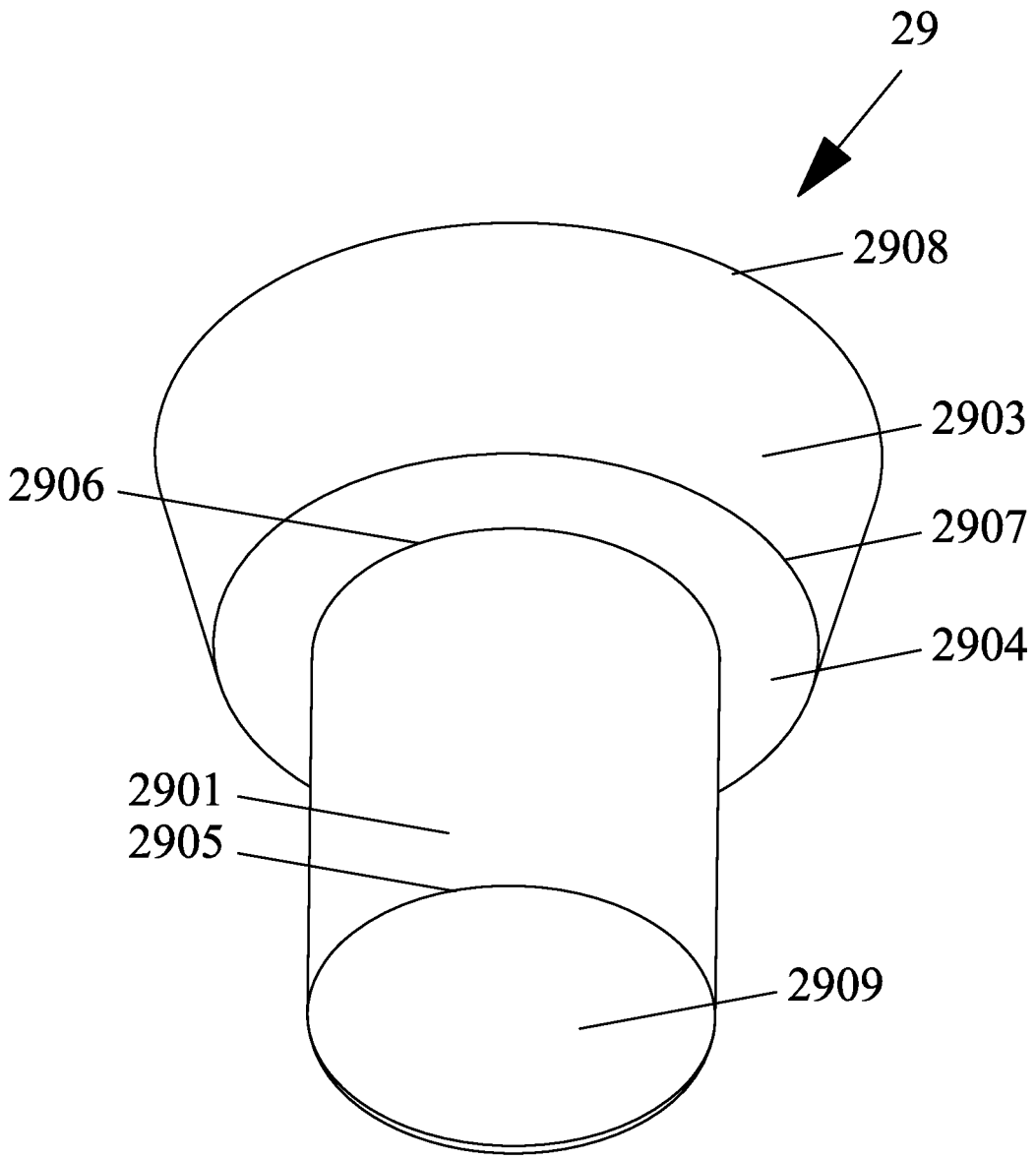
FIG. 2 is another perspective view of a first cup according to one example of the disclosure.
Figure 3:
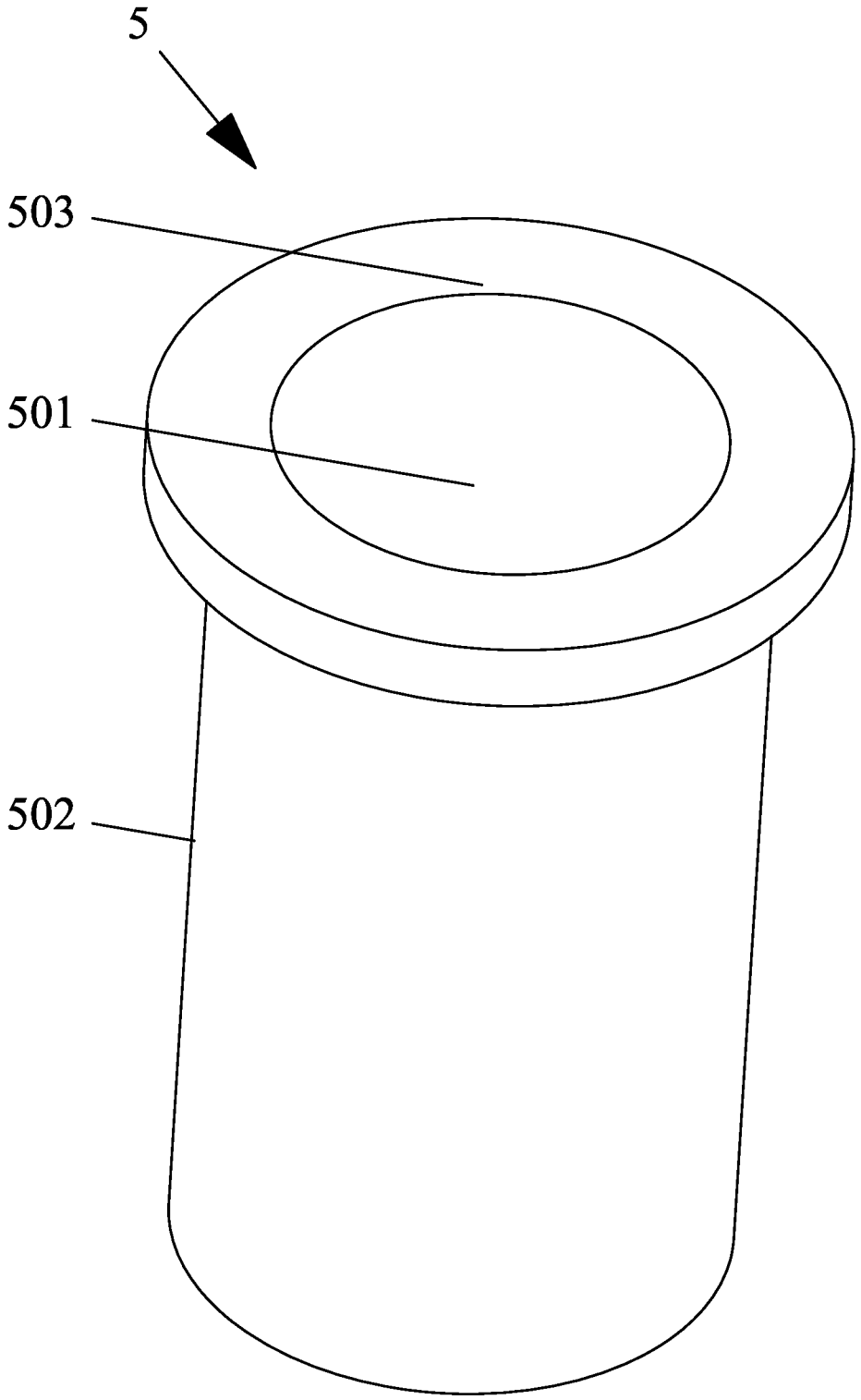
FIG. 3 is a perspective view of a second cup according to one example of the disclosure.
Figure 4:
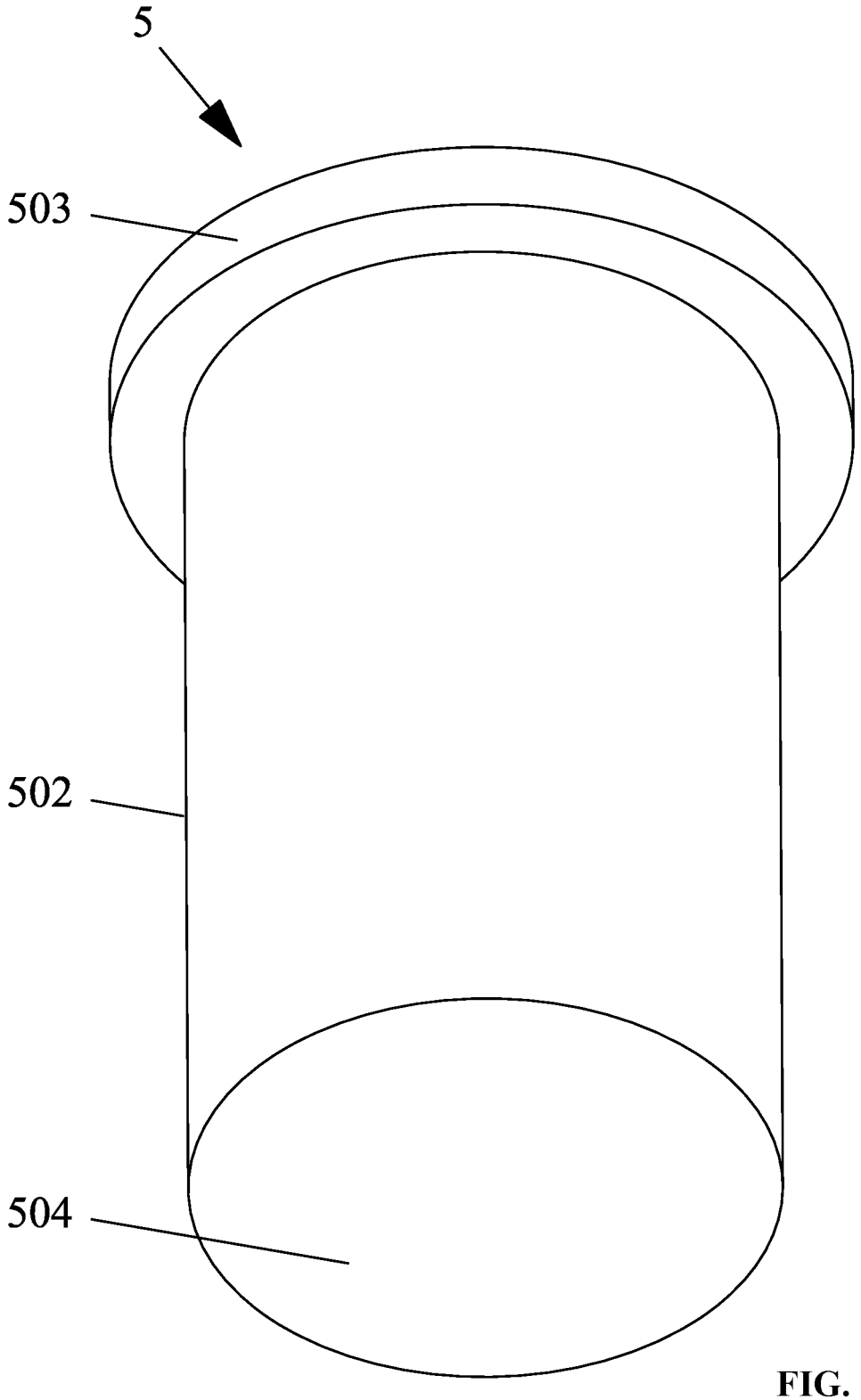
FIG. 4 is another perspective view of a second cup according to one example of the disclosure.
Figure 5:
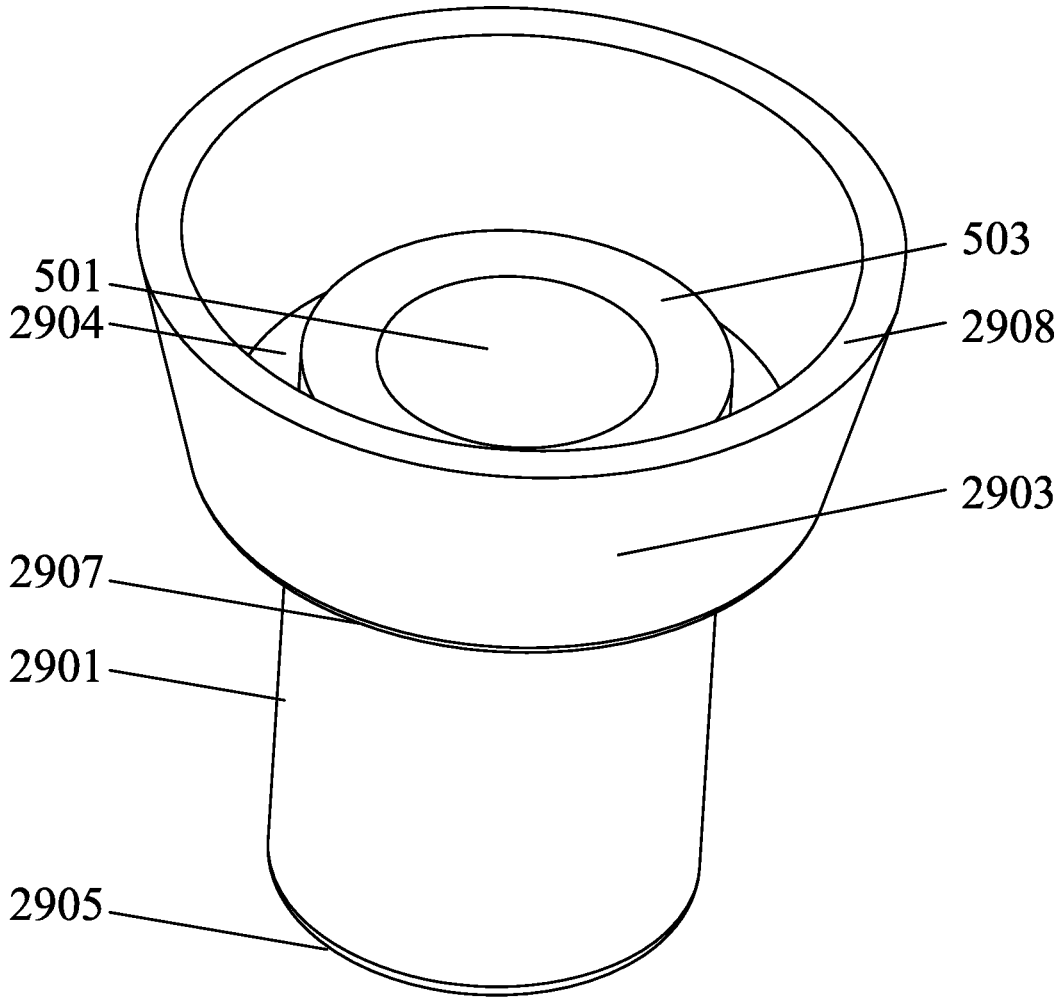
FIG. 5 is a combination view of a first cup and a second cup according to one example of the disclosure.
Figure 6:
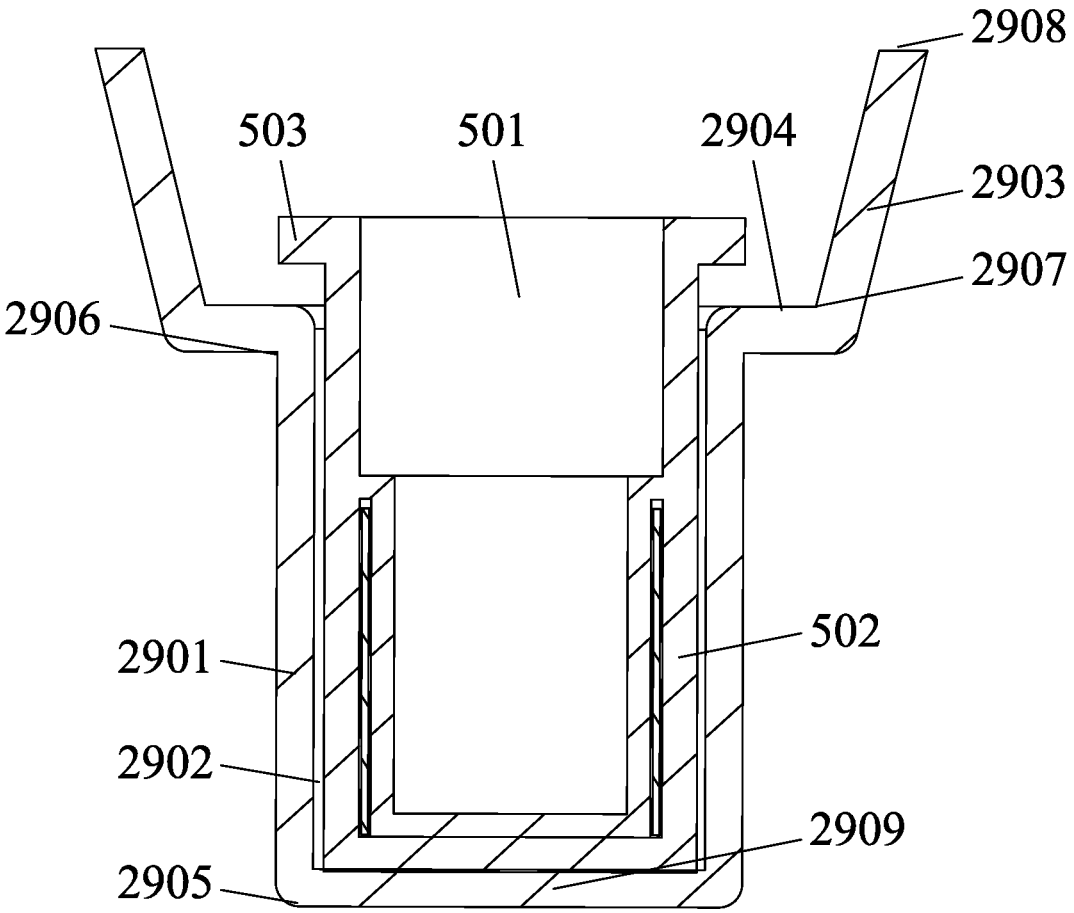
FIG. 6 is a cross-sectional view of a combination of a first cup and a second cup according to one example of the disclosure.

Referring to FIGS. 1-2, the heating cup assembly 10 comprises a first cup 29. The first cup 29 comprises a first cavity 2902, a first side wall 2901, and a second side wall 2903. The first cavity 2902 is surrounded by the first side wall 2901. The first side wall 2901 comprises a first end 2905 and a second end 2906. The second side wall 2903 comprises a third end 2907 and a fourth end 2908. The second end 2906 and the third end 2907 are disposed in one horizontal plane. The second side wall 2903 is in the shape of a truncated cone, and a diameter of the third end 2907 is less than that of the fourth end 2908. Vapor condenses into liquid and flows along the second side wall to re-enter the first cavity, which prevents the condensate overflow from happening in the hookah. Furthermore, the heating cup assembly 10 is detachable, portable, and easy to clean.

In one example of the disclosure, the second end 2906 is secured to the third end 2907 by any suitable connection means such as integral formation or welding. In one example of the disclosure, the heating cup assembly 10 further comprises a connecting wall 2904 extending between the second end 2906 and the third end 2907; and the connecting wall 2904 prevents the condensate overflow from happening.

One end of the first end 2905 comprises a first bottom wall 2909. The first side wall 2901 and/or the first bottom wall 2909 comprises a heating layer. Preferably, the heating layer is disposed on the first side wall 2901 to increase heating area and provide uniform heating. The first cup 29 is used to hold the tobacco materials after being provided with a heating layer.

The first cavity 2902 is used to hold the tobacco materials when the heating layer is disposed in the cavity of the first side wall 2901, and/or on an inner and/or outer surface of the first side wall 2901. Preferably, the heating layer is disposed in the cavity of the first side wall 2901 to prevent oxidation and avoid direct contact with the tobacco materials, thus preserving the taste of the tobacco smoke.

The first side wall 2901, the second side wall 2903, and the first bottom wall 2909 comprise heat-resistant materials such as glass, quartz, ceramics, and agate. The heating layer comprises metals, carbon nanomaterials, or graphene. Preferably, the heating layer comprises metals, thus achieving higher heating efficiency. The heating layer is in the shape of a plane or a mesh. In one example of the disclosure, the first side wall 2901, the second side wall 2903, and the first bottom wall 2909 comprise metals, carbon nanomaterials, or graphene. The metals or the metal layer includes, but is not limited to, copper, silver, tungsten, aluminum, nickel, cadmium, and gold.

Referring to FIGS. 3-6, in one example of the disclosure, the heating cup assembly 10 further comprises a second cup 5 disposed in the first cavity 2902. The second cup 5 is used to hold the tobacco materials after being provided with the heating layer. The first cup 29 functions as a garbage can configured to collect the tobacco materials and the condensate from the second cup 5.

The second cup 5 comprises a third side wall 502 and a second cavity 501 surrounded by the third side wall 502. The second cavity 501 is configured to hold the tobacco materials.

The second cup 5 is detachably disposed in the first cup 29, so it is convenient for the user to replace, clean, and carry.

The second cup 5 exceeds the first side wall 2901 in length, so that the second cup 5 can be taken out the first cup 29. The first cup 29 is used to collect the condensate or the tobacco materials from the second cup 5.

One end of the third side wall 502 comprises a second bottom wall 504. The third side wall 502 and/or the second bottom wall 504 comprises a heating layer. Preferably, the heating layer is disposed on the third side wall 502 to increase heating area, thus achieving uniform heating.

The heating layer is disposed in a cavity of the third side wall 502, and/or on an inner and/or outer surface of the third side wall 502. Preferably, the heating layer is disposed in the cavity of the first side wall 2901 to prevent oxidation and avoid direct contact with the tobacco materials, thus preserving the taste of the tobacco smoke.

The third side wall 502 and the second bottom wall 504 comprises heat-resistant materials such as glass, quartz, ceramics, and agate. The heating layer comprises metals, carbon nanomaterials, or graphene. Preferably, the heating layer comprises metals, thus achieving higher heating efficiency. The heating layer is in the shape of a plane or a mesh. In one example of the disclosure, the third side wall 502 and the second bottom wall 504 comprise metals, carbon nanomaterials, or graphene. The metals or the metal layer includes, but is not limited to, copper, silver, tungsten, aluminum, nickel, cadmium, and gold.

The third side wall 502 is matched with the first side wall 2901 in size and shape so that the third side wall 502 can be disposed into the first cavity 2902. One end of the third side wall 502 extends radially towards the first cup to form a flange 503. The flange is configured to guide the tobacco materials or the condensate to flow from the second cup 5 to the first cup 29, and the flange abuts against the heater.

Example 1

Referring to FIGS. 1, 2, and 7, a hookah comprises the first cup 29, the water jar, and the heater 20. The second side wall 2903 corresponds to the position of the water jar. The first cup 29 is detachably disposed in the top concave portion 201. The first side wall 2901 comprises a metal layer and configured to hold the tobacco materials. When the heater 20 is energized, the metal layer produces heat to burn the tobacco materials. The smoke generated from the first cup 29 first flows into the water jar for filtering and cooling and is then inhaled by a user.

Example 2

Referring to FIGS. 3-7, a hookah comprises the first cup 29, the second cup 5, the water jar, and the heater 20. The second cup 5 is detachably disposed in the first cavity 2902. The first cup 29 is detachably disposed in the top concave portion 201. The second side wall 2903 corresponds to the position of the water jar. The third side wall 502 comprises a metal layer and the tobacco materials are disposed in the second cavity 501. When the heater 20 is energized, the metal layer produces heat to burn the tobacco materials. The smoke generated from the second cup 29 first flows into the water jar for filtering and cooling and is then inhaled by a user. The first cup 29 collects the condensate from the second cup 29, thus facilitating the cleaning of the hookah.

It will be obvious to those skilled in the art that changes and modifications may be made, and therefore, the aim in the appended claims is to cover all such changes and modifications.

What is claimed is:

1. A heating cup assembly, comprising a first cup; wherein the first cup comprises a first cavity, a first side wall, and a second side wall; the first cavity is surrounded by the first side wall; the first side wall comprises a first end and a second end; the second side wall comprises a third end and a fourth end; the second end and the third end are disposed in one horizontal plane; the second side wall is in the shape of a truncated cone, and a diameter of the third end is less than that of the fourth end;

a connecting wall is connected to the second end of the first side wall and the third end of the second side wall;

the heating cup assembly further comprises a second cup detachably disposed in the first cavity; and the second cup comprises a third side wall and a second cavity surrounded by the third side wall;

the third side wall is longer than the first side wall; and the second side wall extends beyond a top of the second cup.

2. The heating cup assembly of claim 1, wherein the first end is connected to a first bottom wall.

3. The heating cup assembly of claim 2, wherein one end of the third side wall comprises a second bottom wall; and the third side wall and/or the second bottom wall comprises a heating layer.

4. The heating cup assembly of claim 3, wherein the heating layer is disposed in a cavity of the third side wall, and/or is attached to an inner surface of the third side wall and/or an outer surface of the third side wall; and the heating layer comprises metal, carbon nanomaterial, or graphene.

5. The heating cup assembly of claim 1, wherein one end of the third side wall extends radially towards the first cup to form a flange.

6. A hookah, comprising a heater and the heating cup assembly of claim 1; wherein the heating cup assembly is detachably disposed on the heater.

7. The hookah of claim 6, wherein the heater comprises a fourth side wall and a top concave portion surrounded by the fourth side wall; the hookah further comprises a coil wrapped around the fourth side wall; and the heating cup assembly is detachably connected to the top concave portion.

* * * * *